United States Patent [19]

Salyer

[11] Patent Number: 4,867,439

[45] Date of Patent: Sep. 19, 1989

[54] LOCOMOTION EXERCISE ENHANCEMENT EQUIPMENT

[75] Inventor: Alan Salyer, Ypsilanti, Mich.

[73] Assignee: The Coach and Company Incorporated, Ypsilanti, Mich.

[21] Appl. No.: 202,799

[22] Filed: Jun. 3, 1988

Related U.S. Application Data

[63] Continuation-in-part of Ser. No. 852,065, Apr. 15, 1986, abandoned.

[51] Int. Cl.[4] ..... A61H 3/00

[52] U.S. Cl. ..... 272/70.3; 272/70; 272/132; 272/DIG. 4

[58] Field of Search ..... 272/70, 70 A, 70.3, 272/70.4, 73, 132, 114, DIG. 4; 74/777

[56] References Cited

U.S. PATENT DOCUMENTS

| | | | |
|---|---|---|---|
| 1,839,096 | 12/1931 | Haalmeijer et al. | 74/777 |
| 3,062,548 | 11/1962 | Foster et al. | 272/130 |
| 3,758,967 | 9/1973 | Thompson | 56/16.7 X |
| 4,289,309 | 9/1981 | Hoffman | 272/73 |
| 4,334,677 | 6/1982 | Tata | 272/70 X |
| 4,438,921 | 3/1984 | Szymski | 272/73 |

*Primary Examiner*—Richard J. Apley
*Assistant Examiner*—Howard Flaxman
*Attorney, Agent, or Firm*—George L. Boller

[57] ABSTRACT

Locomotion exercise enhancement equipment comprises a frame which is supported for rolling motion along ground by a pair of axled wheels. The user either pulls or pushes the frame. A rotary load is supported on the frame and operatively coupled with the axled wheels to cause resistance to be imposed on the rotation of the wheels. A selector control varies the degree of coupling of the wheels with the rotary load to thereby vary the effective load imposed on the wheels. Several embodiments of the locomotion exercise enhancement equipment are disclosed. In one of these embodiments the rotary load comprises a disk that is attached to a housing containing a differential mechanism; as the equipment is rolled, the wheels drive the differential mechanism, causing the housing and the disk to rotate. A caliper brake mechanism disposed in association with the disk is set by an adjustment mechanism to impart a desired force against opposite sides of the disk, and thereby set the desired loading.

20 Claims, 7 Drawing Sheets

LOCOMOTION EXERCISE ENHANCEMENT EQUIPMENT

REFERENCE TO A RELATED APPLICATION

This application is a continuation-in-part of co-pending application Ser. No. 852,065, filed Apr. 15, 1986, now abandoned.

BACKGROUND AND SUMMARY OF THE INVENTION

This invention relates generally to exercise equipment. More particularly it relates to equipment which is operable by a user during locomotion activities to enhance the benefit of locomotive exercise according to the particular desires of the individual.

Increasing awareness of the health benefits of regular exercise have lead to an increase in the amount of exercise equipment in use. For the most part this exercise equipment is stationarily located, such as gyms, homes, or training facilities. Some of applicant's inventions relate to improvements in this type of exercise equipment and reference is made to applicant's issued U.S. Pat. Nos. 4,549,733 dated Oct. 29, 1985 and 4,657,246 dated Apr. 14, 1987.

It is also recognized that human locomotion activity can have a beneficial health effect if regularly one. This refers to running and walking exercises, and while these can be performed indoors or outdoors, it is generally more conductive for individuals to engage in such activities out-of-doors, at least where weather conditions permit.

In order to obtain beneficial health effects, it has been documented that a certain minimum level of exercise activity is required. While for any given individual the level will depend upon that individual's particular physical condition at the time, it is generally fair to say that a reasonably healthy individual will require a significant amount of locomotive activity in order to obtain physical benefit, particularly for the cardiovascular system. It has been shown necessary to generate a certain minimum level of cardiovascular activity before cardiovascular benefit will occur. For some individuals, moderate walking may be a sufficient level of activity to generate therapeutic effects, yet for other individuals distance running may be necessary. The extent to which an individual's cardiovascular system is exercised will also depend upon the nature of the surroundings over which the locomotive activity takes place. For example, on flat terrain a lower load is imposed than would be the case for locomotive activity over hilly terrain.

In order to enhance the effectiveness of exercise activity, and this includes locomotive exercise activity, individuals may add weights to parts of their bodies in order to increase the loading imposed on the cardiovascular and muscular systems. Hence, running with an extra ten pounds of weight for example, will result in the attainment of a given level of cardiovascular activity sooner than would be the case where weights are not used.

The use of weights typically requires a means for attachment of the weights to the body and this often involves the use of holders for the weights which are strapped onto the user. It requires extra time to attach and remove the weights, and in general it also means that over the course of performing exercise the same amount of weight will be used unless the individual stops and either removes or adds to the amount of weight. Where the user is exercising over the road, he or she may be a distance from the starting and stopping points and therefore it may be impractical to change weights over the course of the route. Moreover, because such weights will have to be placed somewhere on the body, there may be effects on certain parts of the body which may not be desired because of the need to attach the weights. The weights also change the user's natural center of gravity.

The present invention is directed to equipment for enhancement of locomotive exercise without the use of weights attached to the body. Equipment of the present invention offers significant benefits over other type of equipment, such as weights, and is intended to enhance the effectiveness of locomotive exercise Equipment of the present invention can be utilized for walking, jogging, and running. It is well suited for over-the-road operation on different types of terrain be it grass, dirt, concrete or otherwise. Another advantage of the invention is that it is readily adapted for individual human use without the need for any elaborate attachment mechanism to the individual. Indeed, in the disclosed preferred embodiment, the equipment is operable simply by the user grasping it and pulling or pushing. The equipment also has the ability for adjusting the loading effect on the individual to different levels. This is important because the user can then adapt the load to his or her desired rate of locomotion. In other words for example, the user can walk with the equipment imposing a higher load (i.e. torque) than might be imposed when the user desires to run. This adjustment can be quickly accomplished by the user, and indeed can even be done, while the user continues to locomote. Moreover, appropriate load selection by the user enables "progressive resistance type" locomotive exercise to be performed.

A still further advantage of the invention is that its construction is not particularly complicated. Embodiments of the invention can be fabricated out of existing known components and several specific examples of construction are disclosed in the drawing figures.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

BRIEF DESCRIPTION OF THE DRAWINGS

FIG. 10A is a fragmentary view in the direction of arrows 10A—10A in FIG. 10.

FIG. 11A is a fragmentary view in the direction of arrows 11A—11A in FIG. 11.

DESCRIPTION OF THE PREFERRED EMBODIMENT

Figure 1:
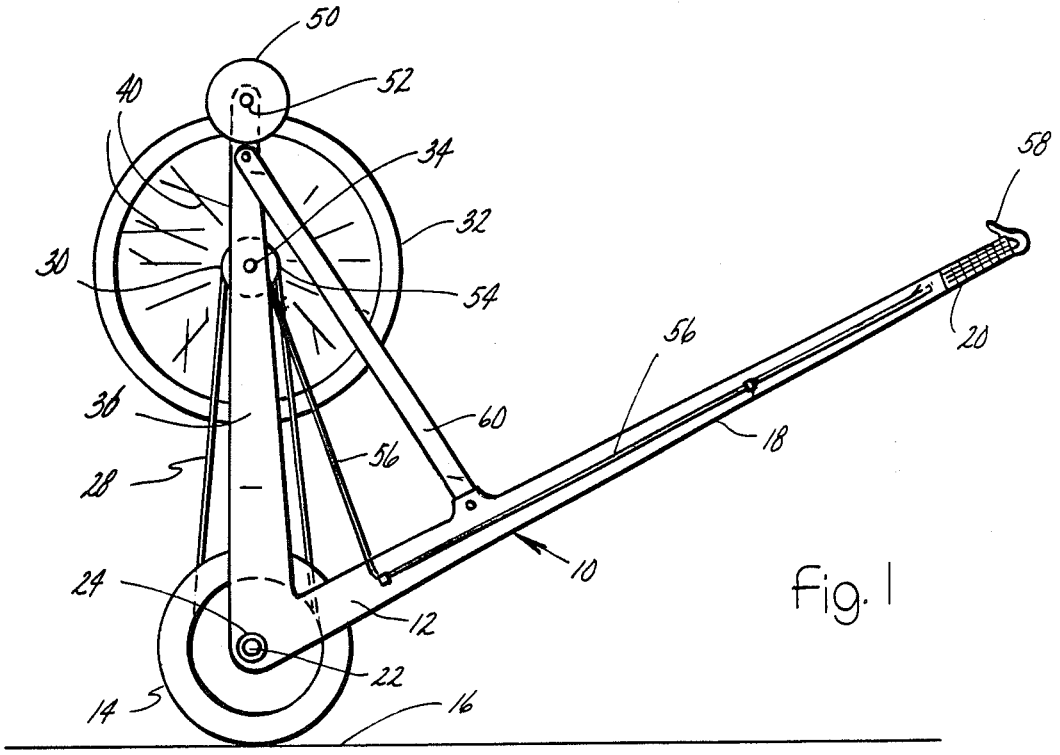
FIG. 1 is a side elevational view of the first embodiment of exercise equipment embodying principles of the present invention.
Figure 2:
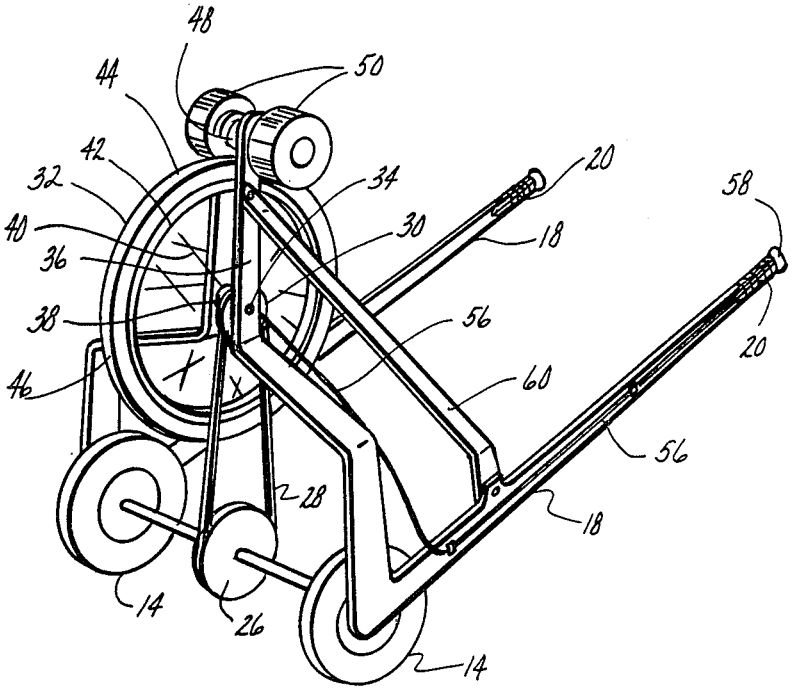
FIG. 2 is a perspective view of the equipment of FIG. 1.

FIGS. 1 and 2 illustrate exercise equipment in the form of an exercise machine 10 embodying principles of the invention. Exercise machine 10 comprises a frame, generally 12, which is supported by a pair of axled wheels 14 for travel over the ground 16. FIGS. 1 and 2 represent a typical orientation of a machine when in use by an individual. The frame 12 includes a pair of metal bar members 18 which extend upwardly and forwardly from the point at which the axled wheels 14 are attached. A typical length for the members 18 will be on the order of at least several feet, and as an example, a length of five or six feet is believed most appropriate for general use. The ends of the bar members 18 opposite wheels 14 have hand grips 20 which may include rubber-like hand grip members fitted on the ends.

The machine can be either pulled or pushed by the user. In a pulling use, the individual stands between the two members 18 forwardly of the axled wheels 14, and faces away from the machine. In a pushing use, the user still stands between the members 18, but now faces the machine. The individual's hands grasp the hand grips 20 and when the user moves forwardly, either waling, jogging or running, he either pulls or pushes the machine along with him, the axled wheels 14 supporting the machine for rolling motion along ground 16.

While the weight of the machine itself would constitute an additional exercise load for the individual user, the exercise machine further includes a means for varying the effective load due to rolling of the wheels 14 over the ground.

The wheels 14 are keyed to an axle shaft 22 which extends transversely between the sides of the frame. The ends of the axle shaft are journaled in suitable journal bearings in the frame, as at 24. A driving sprocket 26 is keyed to axle shaft 22 near a central point of the axle shaft. An endless chain 28 extends from sprocket 26 to engage a driven sprocket 30 which is keyed to a wheel 32. The wheel 32 is supported via an axle 34 upright portions 36 of the frame. These upright portions are best seen in FIG. 2 and comprise a shape as shown. Thus wheel 32 is placed in a driven relationship to wheels 14 by virtue of sprocket 26, chain 28, and sprocket 30. In other words as the machine is pulled along the ground by the user, the rotation of wheels 14 is transmitted through sprocket 26, chain 28 and sprocket 30 to rotate wheel 32.

Wheel 32 may be a conventional bicycle wheel comprising a central hub 38 having wire spokes 40 radiating to support a metal rim 42 on which is seated an inflated tire 44. The tread 46 of the tire is in contact with a roller 48 which is supported between the two upright members 36 just above wheel 32. (See FIG. 3 also for details.) The roller 48 is journaled for rotation on the frame via a shaft 52 and the illustrated embodiment shows a pair of squirrel cage blower wheels or fans 50 supported on shaft 52 to each side of the respective uprights. Hence rotation of wheel 32 is effective to rotate roller 48 and in turn the squirrel cage blower wheels 50. It is to be observed that roller 48 is of a much smaller diameter than that of wheel 32 and therefore the roller and squirrel cage blowers 50 will rotate at considerably higher RPM than will wheel 32. There are different ways to vary the force by which the tire tread 46 engages roller 48; for example, the inflation pressure of the tire can be varied, and/or adjustable mounting provisions between the roller and the wheel will enable a desired engagement force to be obtained. The blowers 50 will work against air and thereby constitute the end load which is imposed on the machine.

In order to obtain variable load, wheel 32 is provided with a change gear mechanism 54. This change gear mechanism may be any suitable type, and for example the type commonly used in multi-speed bicycles is very appropriate. For instance a three speed gear mechanism would provide three different gear ratios in the coupling between the chain 28 and wheel 32. More elaborate mechanisms such as derailers would provide increased speed ranges, for example a ten speed.

As in a bicycle, the gear ratio is controlled via a cable mechanism 56. One end of the cable attaches to the wheel in the vicinity of the hub and sprocket. The other end connects to a gear selector lever 58 which is preferably located adjacent one of the hand grips for convenient use by the individual. In this way the user can change gears while continuing to exercise. The user may set the gear ratio to any appropriate level which is desired for exercise. If the user desires to obtain a heavier exercise but without having to run, he can set the gears to a high gear ratio. If the user desires to locomote at a running pace but without too heavy a load, then a lower gear ratio can be selected. The invention is especially advantageous for exercising over hilly terrain because then the gear ratio can be readily changed to accommodate the differences in going up or down a hill versus travel over reasonably flat terrain.

By making the wheels 14 of a sufficiently large diameter, better ground engagement action is obtained than is likely the case where the wheels are smaller. Hence, the proportions shown in the drawing figures are considered to be somewhat representative although principles of the invention will apply in many different proportions. While the blower wheels constitute the end load which is driven by the user's operation of the exercise machine, it will be appreciated that the weight of the machine and the rotation of the other members also constitute additional loading. With the invention, the user can obtain a desired level of exercise activity which is compatible with his desired rate of locomotion. The particular details of construction will also depend upon any given design. In the example illustrated, the frame may be constructed of sheet metal members. It shows the use of diagonal braces 60 to assist in secure support of the uprights from the frame.

Figure 3:
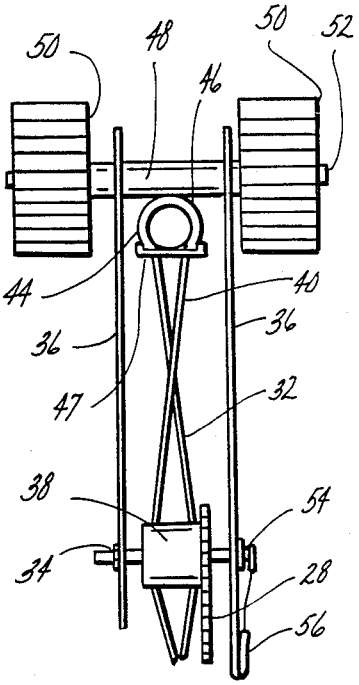
FIG. 3 is a fragmentary view in the direction of arrow 3 in FIG. 1.
Figure 4:
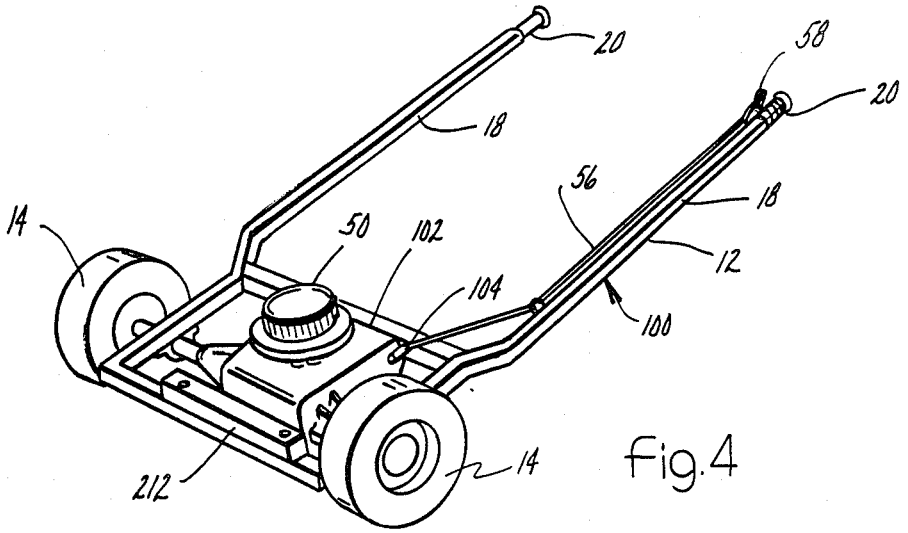
FIG. 4 is a perspective view of a second embodiment of exercise equipment embodying principles of the invention.

FIG. 4 portrays a further embodiment 100 of exercise machine embodying the same general principles as the machine of FIGS. 1, 2 and 3 but through the use of different mechanism. This embodiment 100 does not utilize the bicycle wheel type mechanism. Rather that mechanism is replaced by a small transaxle assembly 102 of the type which is commonly used in association with small two-cycle internal combustion engines in riding mowers, lawn tractors, snow blowers and the like. However, unlike the use of a transaxle in those applications, the use of a transaxle in the present application involves the transaxle being driven in reverse. In other words the axled wheels are coupled to the usual output shafts of the transaxle and the squirrel cage blower wheel are attached to the usual input shaft so that the power flow through the transaxle is from output to input. The standard gear control mechanism 104 of the transmission is operated by a cable system 56 and gear selection lever 58. In use, the individual sets the desired transmission gear ratio through the cable system and either pulls or pushes the exercise machine in the same manner described for the embodiment of FIGS. 1, 2 and 3.

A typical transaxle 102 has multiple gear ratios and for example there can be transaxles with up to eight such ratios. Because the transaxle is driven in reverse, the input shaft will rotate at a considerably higher speed than the wheels which are attached to the output shafts, and therefore the squirrel cage blower will rotate at a relatively high velocity in comparison to the speed of the wheels 14 thereby interacting with ambient air to create the end load. The moving parts in the transmission itself will also contribute to some of the load, as will the rotation of the wheels. However, the same exercise principles are applicable to the machine of FIG. 4 as described for the machine of FIGS. 1, 2, and 3. Because the machine of FIG. 3 does not utilize the bicycle wheel type mechanism it has a lower profile than the machine of FIGS. 1 and 2.

Figure 5:
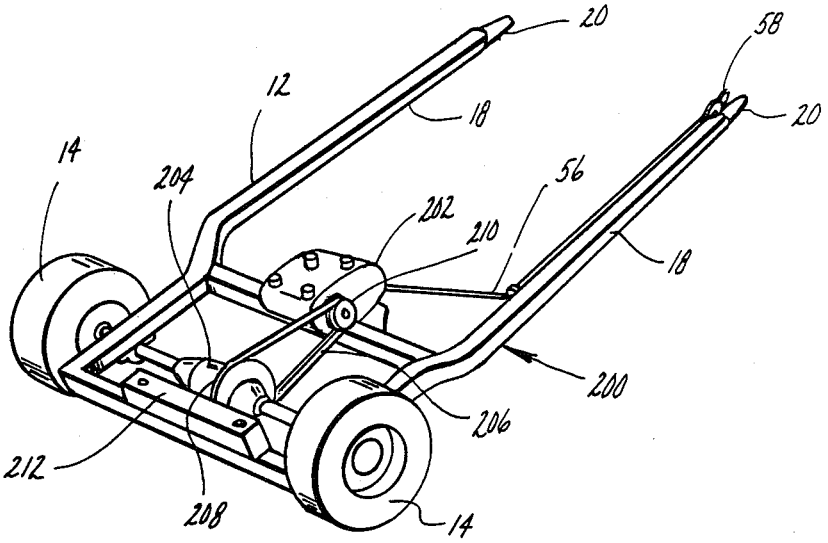
FIG. 5 is a perspective of a third embodiment of exercise equipment embodying principles of the invention.

FIG. 5 illustrates still another embodiment of exercise machine 200. This embodiment is in certain respects similar to the embodiment of FIG. 4. It utilizes a small transmission 202 of the type used in riding lawn mowers and like application. However the type of transmission 202 is different from the axle 102 of FIG. 4 and therefore the differential 204 is a separate assembly. Wheels 14 are on the axle shafts of the differential, and the differential is driven in reverse. The differential is coupled with the transmission by a chain 206 and sprockets 208, 210 so that the rotation of wheels 14 in response to use acts through the differential to cause the transmission's usual output shaft to be rotated. The transmission 202, like transaxle 102, is driven in reverse with the transmission itself constituting the end load. If a blower wheel is attached to what is the usual input shaft 211 of the transmission, it will rotate at comparatively high RPM to interact with ambient air in imposing more load during use. As in the other embodiments however, the motion of the various moving parts also imposes some loading. Operation of the cable mechanism will control the gear ratio between the transmission input and output shafts and therefore control the relationship of blower wheel speed to the speed of wheels 14. In this way the user can set the exercise machine to a desired load for a desired rate of locomotion. The use of a differential may have certain advantages where the exercise machine is operated along sharply curved routes. However the Other machines are also capable of being used in other than straight line motion. Whether any given machine will benefit from the use of a differential will depend upon the extent of severity of any curved portions of a route over which the machine will be used. The machine of FIG. 5, like that of FIG. 4, has a lower profile in comparison to the machine shown in FIGS. 1 and 2.

The transaxle and transmission of FIGS. 4 and 5 add additional weight to the exercise equipment which is disposed eccentric to the axis of rotation of wheels 14. It may be deemed desirable to counterbalance the effect of this added weight by adding a counterbalancing weight 212 as shown in both FIGS. 4 and 5 on the frame at a location relative to the axis of rotation of wheels 14 opposite the location of the transmission mounting. In the position of use such as represented in the drawing figures, it is desirable for the machine to be counterbalanced so that excessive downward forces imposed on the user at the hand grips can be avoided. It may be possible however to dispense with separate counterweight if the heavier component parts are mounted in positions of better balance.

Because the member 18 are inclined at an acute angle so that the hand grips are disposed at a convenient level for grasping by the user, it may happen that there is a slightly different effect when the user is operating the equipment by pulling than in the case of pushing. When the user pulls the machine there will be a tendency to impart an upward component of force whereas when the user is pushing there will tend to be a downward component of force. This can have an effect during starting and stopping; for example, when starting to use the equipment by pulling, there may be an initial lifting which will result in momentary reduced traction. By the same token a pushing of the machine will tend to create increased traction between the wheels and ground. Regardless of whether pushing or pulling is used, the exercise machine enables locomotive exercise enhancement to be obtained by the user according to the user's particular desires.

There can be other ways for the user to operate the machine. For example, it may be desirable to incorporate a bar extending transversely across the frame between the ends where the hand grips are located. The user can then grasp the bar to operate the machine and this may be convenient for pushing. Separate hand grips need not necessarily be incorporated, as in FIG. 5, and the user may simply grasp the ends of members 18. In a pushing use of the machine, it has been found that a single member 18 centrally located with a short handle at its free end (like on a push mower) is quite comfortable.

The foregoing has described improvements in exercise equipment for association with an individual performing exercise via locomotion. The equipment is convenient for use because it can be readily grasped by the user's hands and either pulled or pushed. However other coupling arrangements with the individual user are envisioned within the scope of the invention.

Likewise the use of other types of end loads than the blower wheels illustrated are also envisioned. The end load could also comprise fluid circuit devices, such as pump-motor systems for example, or magnetic, electrical, or electromagnetic circuit devices, such as motor-generator systems for example. As noted, it can even be the case, which is in the transaxle and transmission versions of FIGS. 4 and 5, that the transaxle and the transmission gears themselves constitute the end load. The internal lubrication of these assemblies (i.e. oil) has shown sufficient interaction with the internal gears to contribute to the load. For example, FIG. 5 shows the transmission without any additional exterior load (such as the blower wheel) o its input shaft, relying on the transmission gear train itself as the load. A less expensive model could omit the cable and utilize a transmission or transaxle mounted shift lever.

The particular detailed design of any given machine can be determined through the use of conventional engineering principles to match the typical loading range which an individual can pull or push to the particular speed ranges which an individual can perform. For example a slow walking exercise at a speed of perhaps one or two miles an hour might constitute a low range. A faster running speed of say 10 to 12 miles an hour for example might be another extreme. The size of the load range can also be adapted to the needs of a particular individual using a particular machine. For example a larger and stronger individual might use a larger blower wheel than a smaller individual even though the machines still have the ability to vary the load.

Other forms of variable load are contemplated within the scope of the invention. An example would be a selectable force acting on the wheel, such as the bicycle wheel of FIGS. 1, 2, and 3, to impose selectable rotary resistance. Suitable mechanisms for doing this are friction brake mechanisms such as spring-loaded calipers acting on a disc, or shoes acting on a drum. These loads could be incorporated either in addition to, or in substitution of, the change gear mechanism.

FIGS. 6–13 portray another embodiment 300 of locomotion exercise enhancement equipment according to the present invention. Exercise machine 300 comprises a sturdy rectangular shaped chassis frame 302. A wheel and axle assembly, 304 generally, mounts on one side of frame 302 and is disposed in a direction parallel to the longer dimension of the frame and more or less centered with respect to the shorter dimension of the frame. A push, or pull, bar assembly 306 mounts to the side of frame 302 opposite wheel and axle assembly 304. The bar assembly 306 is located centrally of and perpendicular to the longer sides of frame 302. It extends in length a suitable distance from frame 302 so that a handle bar 308 that is at the far end can be conveniently grasped by an individual when using the exercise machine to perform locomotive exercise.

Figure 6:
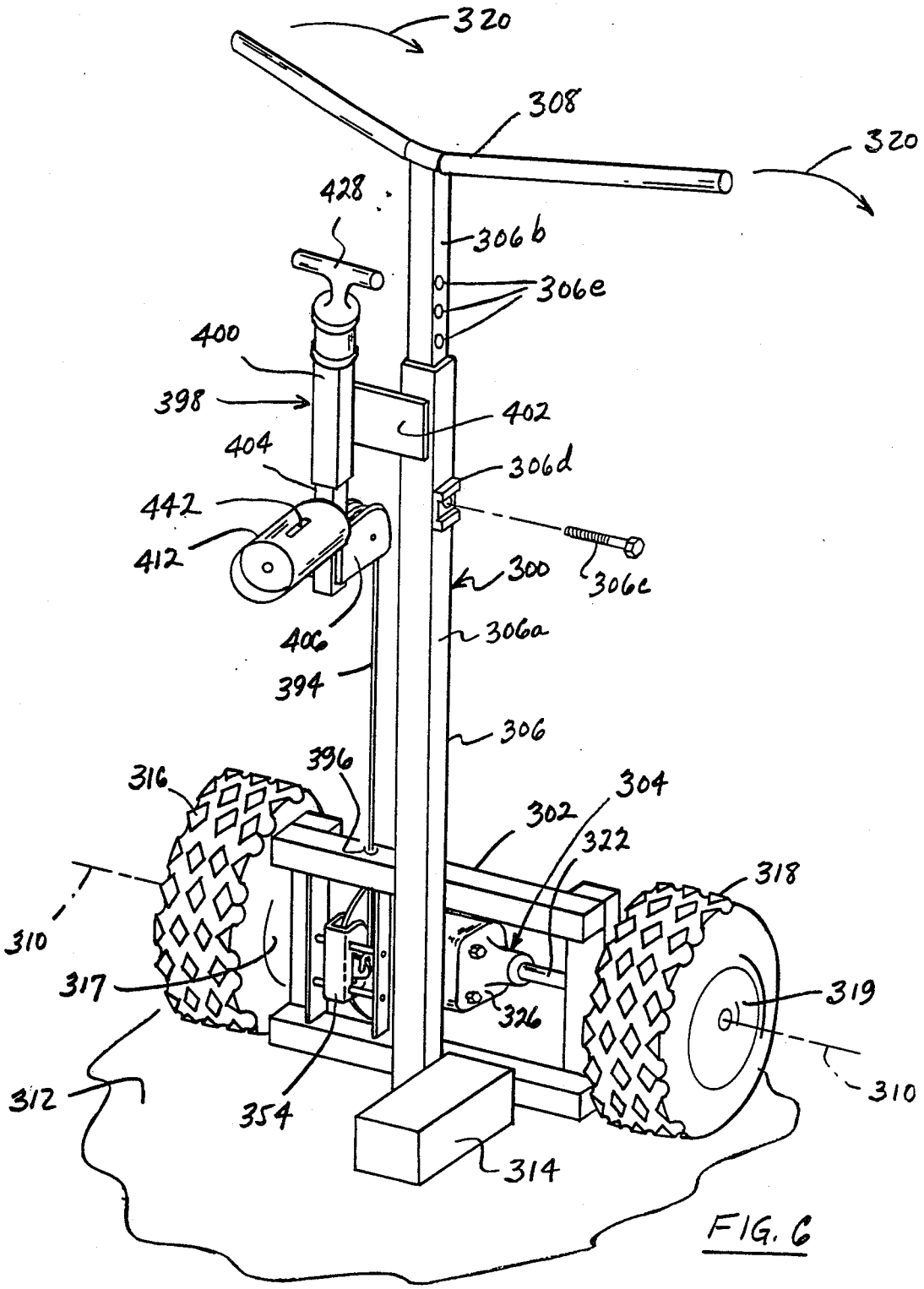
FIG. 6 is a perspective view of a fourth embodiment of exercise equipment embodying principles of the present invention shown in an upright, at-rest position.

FIG. 6 illustrates exercise machine 300 at rust with both frame 302 and bar assembly 306 generally upright. The wheel and axle assembly 304 serves to support the machine on an underlying support surface such as a sidewalk, or road, ground or the like. When the machine is put to use, frame 302 and bar assembly 306 pivot as a unit about the axis of wheel and axis assembly 304, the axis being designated by the reference numeral 310, and a representative surface on which the machine is supported being designated by the reference 312.

The upright at-rest position is attained by the provision of a counterweight 314 that mounts o frame 302. The illustrated counterweight comprises a rectangular shaped block of metal that is arranged perpendicular to frame 302 and projects from the frame in a direction away from .assembly 306. The counterweight is mounted on the lower portion of frame 302 so that the counterweight itself will rest against surface 312 when the exercise machine is in the upright at-rest position shown in FIG. 6. Hence, in the at-rest position, exercise machine 300 has a stable three point support on surface 312 provided by counterweight 314 and the two wheel-mounted tires 316, 318 that are at the opposite ends of wheel and axle assembly 304. The tires 316, 318 are conventional pneumatic rubber tires that mount on conventional wheels 317, 319 in conventional manner. It is to be appreciated that the effect of counterweight 314 is to bias frame 302 and push bar assembly 306 to this upright at-rest position while also providing a certain counterbalance effect when the machine is being rolled along surface 312 during use.

When the exercise machine is to be put to use, the handle bar 308 is grasped and first pulled in the general direction indicated by the arrows 320 in FIG. 6. This will result in frame 302, bar assembly 306 and counterweight 314 being rotated about axis 310 so that the machine assumes a generally inclined position for pulling or pushing. In such an inclined position, the machine is supported on surface 312 only by tires 316 and 318.

In this inclined orientation the exercise machine may be either pushed or pulled via handle bar 308.

Figure 7:
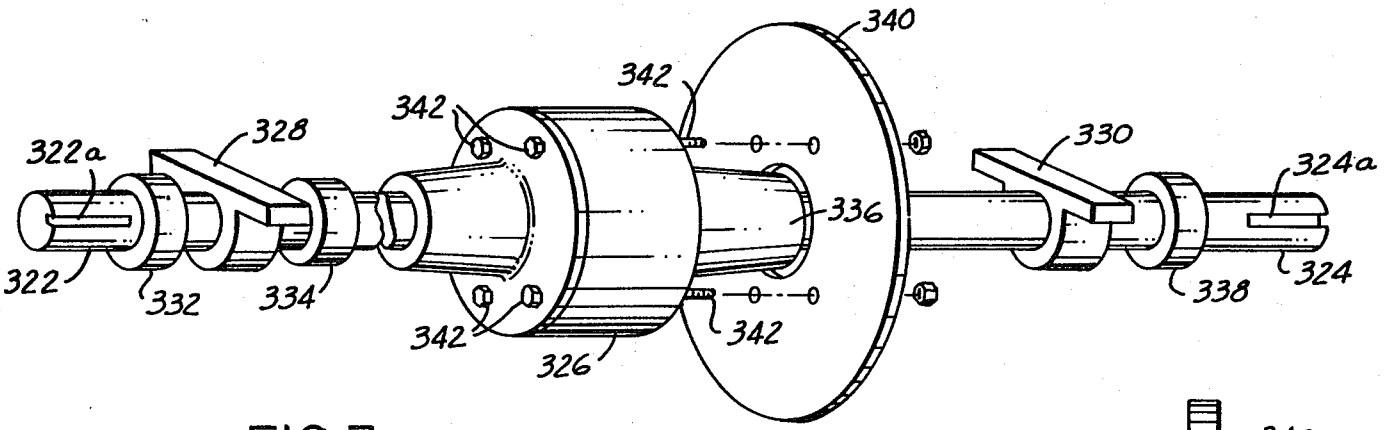
FIG. 7 is a perspective view of one portion of the embodiment of FIG. 6.
Figure 8:
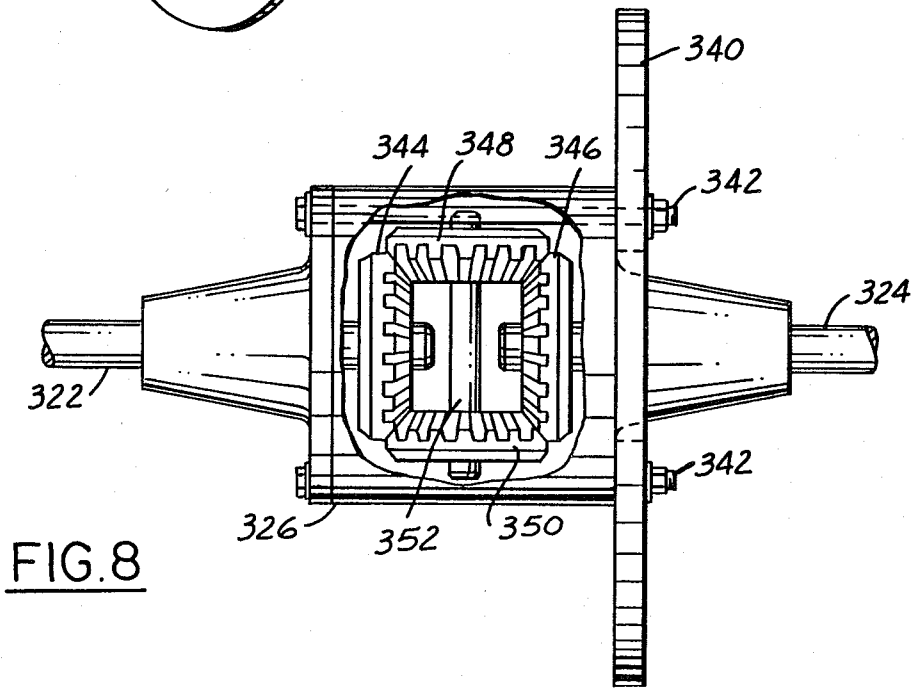
FIG. 8 is a fragmentary longitudinal view, having portions broken away, of the central region of the mechanism shown in FIG. 7.

Further detail of wheel and axle assembly 304 can be seen in FIG. 7 which shows the wheels and tires removed from the ends of the assembly. Although not shown in this FIG., wheels 317, 319 mount on the ends of the assembly of FIG. 7 in conventional manner. The assembly comprises a first axle shaft 322 for one of the wheels and a second axle shaft 324 for the other of the wheels. These two axle shafts 322, 324 project from opposite sides of an epicyclic gear unit 326. The ends of shafts 322, 324 have respective keyways **322*a*, 324*a* for use in keying wheels 317, 319 so that each wheel will rotate the corresponding shaft when the machine is rolled along surface 312. Shaft 322 is received in a pillow block 328 and shaft 324 in a pillow block 320. The two pillow blocks in turn have mounting flanges that serve for attachment to the shorter side members of frame 302 thereby mounting the wheel and axle assembly to the frame. Pillow block 328 is disposed axially between a pair of collars 332, 334 on the corresponding shaft 322. Pillow block 330 is disposed axially on shaft 324 between the end 336 of the housing of unit 326 and a collar 338. The two collars 332, 338 are axial locators for the respective wheels 319, 317. The organization and arrangement is such that assembly 304 is axially constrained on frame 302 although it can rotate about axis 310 by virtue of the pillow block mounting. Because unit 326 is disposed more toward wheel 317 than wheel 319, shaft 324 is correspondingly shorter in length than shaft 322**.

A circular annular brake disk 340 is mounted concentric with axis 310 and fastened against one side face of the housing of unit 326. The assembly of disk 340 to the housing of unit 326 is perhaps best seen in FIG. 8. The housing of unit 326 comprises a hollow interior space cooperatively defined by parts that are held in assembly by four through bolts 342. These through bolts 342 are used to fasten disk 340 to the one side face of the housing in the manner shown.

The two axle shafts 322 and 324 form inputs to unit 326. Affixed to the end of each shaft 322, 324 which is interior of unit 326 is a corresponding beveled pinion gear 344 and 346 respectively. These two gears are substantially identical. Unit 326 further contains a second pair of identical gears 348 and 350 each of which meshes with both gears 344, 346 as shown. The two gears 348, 350 are coaxially journaled on the housing of unit 326 by means of a common shaft 352 whose axis is perpendicular to axis 310.

The two axle shafts 322, 324 will cause unit 326 to rotate when both shafts are rotated in the same sense about axis 310. Unit 326 will rotate about axis 310 at a speed that is equal to the average of the sum of the rotational speeds of the two shafts 322, 324. Under the condition where both shafts are rotating at the same velocity in the same sense, unit 326 will rotate in that same sense and at the same velocity as each shaft. Similarly, if the direction of rotation of both shafts is reversed, so will the direction of rotation of unit 326. The velocity of unit 326 will once again be the average of the two shaft speeds and in the specific case where each shaft is rotating at the same speed, unit 326 will rotate in the same sense as the two shafts and at the speed of each shaft.

Since disk 340 is rigidly affixed to the housing of unit 326, it will rotate in the same manner as unit 326 in response to operation of the two shafts. It will therefore be appreciated that when exercise machine 300 is put to use by an individual either pulling or pushing on handle bar 308, the machine will roll along surface 312 rotating disk 340 in the process. This mode of operation will obviously create a certain amount of resistance an that resistance is due strictly to whether or not the surface is horizontal, and to the friction and inertia of the moving parts.

The machine is designed so that a much greater loading effect can be obtained, and in particular a loading effect that is selectable over a range of different loadings in accordance with the desire of the individual using the exercise machine. In this way the user can set the machine to a desired load resistance against which he or she wishes to work out. Attention will next be directed to the manner in which this variable load resistance capability is achieved.

Mounted on frame 302 to the far side of bar assembly 306 viewed in FIG. 6 is a caliper type friction brake unit 354. The unit is shown in further detail in FIGS. 9 and 13. Unit 354 is supported on a pair of parallel, spaced apart circular rods 356, 358 that mount on frame 302. The unit comprises a stamped metal cover 360 that comprises an overlying top wall 362 and side walls 364, 366. Circular axles are provided in the top corners of each side wall 364, 366 for fitting of unit 354 onto rods 356, 358. The two brake calipers 368 and 370 are disposed interior of cover 360. The cover spans both sides of disk 340 and one caliper is to one side of the disk while the other caliper lies to the other side of the disk. The two calipers have respective friction pads 372, 374 that confront disk 340. The ends of each caliper 368, 370, contain notches 371 via which the calipers are supported on the rods 356, 358 in a manner that allows the calipers to slide axially along the rods.

Brake unit 354 is adapted to cause the friction pads 372, 374 to forcefully engage the opposite sides of disk 340 thereby creating balanced friction forces on each side of the disk. The mechanism for forcing the pads into such frictional contact with the disk further comprises a cam 376 and a roll pin 378. Sidewall 364 contains a horizontal slot 377 for cam 376 and a vertical cylindrical groove 379 for roll pin 378. Cam 376 is a stamped metal part having a shape as illustrated. Roll pin 378 is arranged vertical to the plane of cam 376 and is pressed into, or otherwise secured in, a suitable hole in the cam at the location indicated. Cam 376 has a camming surface 380 that is adapted to engage the face of caliper 368 that is opposite the face containing pad 372.

Figure 13:
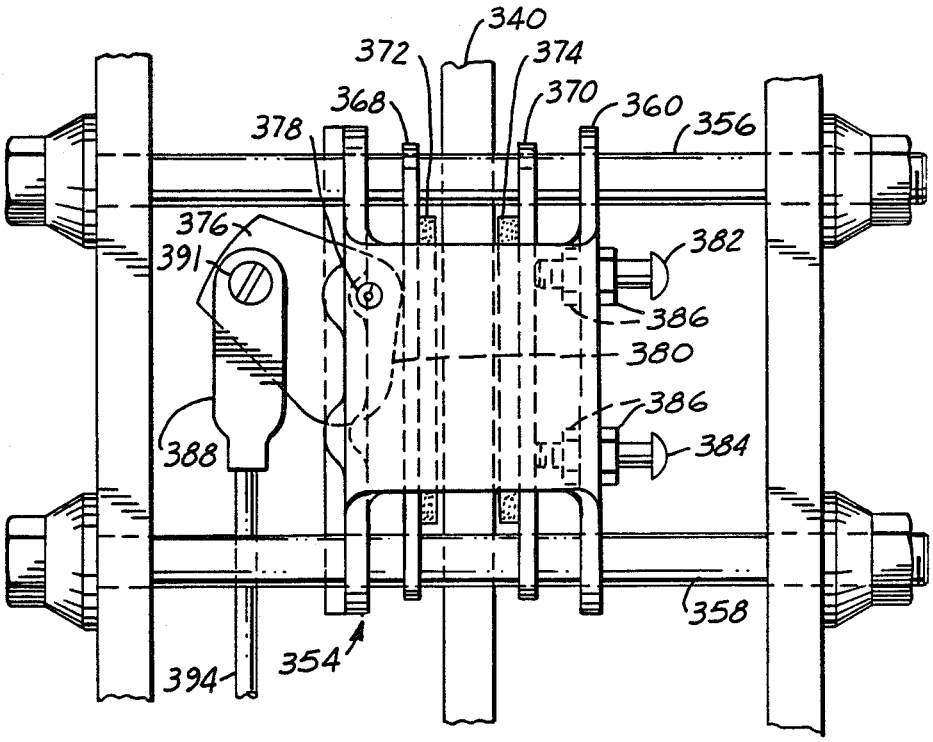
FIG. 13 is a fragmentary top plan view of FIG. 9.

In the position shown in FIG. 13, it can be seen that both pads are spaced just slightly from disk 340. However, if cam 376 is rotated about the axis of roll pin 378 in the counter-clockwise sense as viewed in FIG. 13, camming surface 380 will tend to urge caliper 368, and hence pad 372, toward disk 340. Since cover 360 is slidably mounted on rods 356 and 358, resistance encountered by pad 372 engaging disk 340 will result in the cover being shifted to the left in FIG. 13 once the resistance of caliper 68 and its pad 372 against disk 340 is initially encountered.

It can be seen that side wall 366 of cover 360 contains a pair of screws 382, 384. These screws are locked in place on side wall 366 by means of locking nuts 386 that are tightened against opposite sides of wall 366. The shank ends of screws 382, 384 are disposed equal distances from wall 366 so that when cover 360 is shifted to the left in FIG. 13, the screws will push caliper 370, and hence pad 374, also to the left. This will continue until such time as pad 374 comes into frictional contact with disk 340, and at this time, the forces of the respective pads 372, 374 acting on the disk are substantially equalized. Continued counter-clockwise rotation of cam 376 from this point will result in increasing forces being applied in a substantially equalized manner to opposite sides of disk 340. Accordingly, the frictional resistance that is applied by pads 372, 374 to disk 340 will be a function of how far cam 376 is rotated counter-clockwise about the axis of roll pin 378. Increasing counter-clockwise rotation of the cam in the sense of FIG. 13 will cause the frictional resistance to increase. Clockwise rotation will decrease the frictional resistance. It can therefore be seen that the unit 354 is effective to impart variable load resistance to disk 340. The manner in which the load resistance is set by the person using the exercising machine will no be described.

Figure 9:
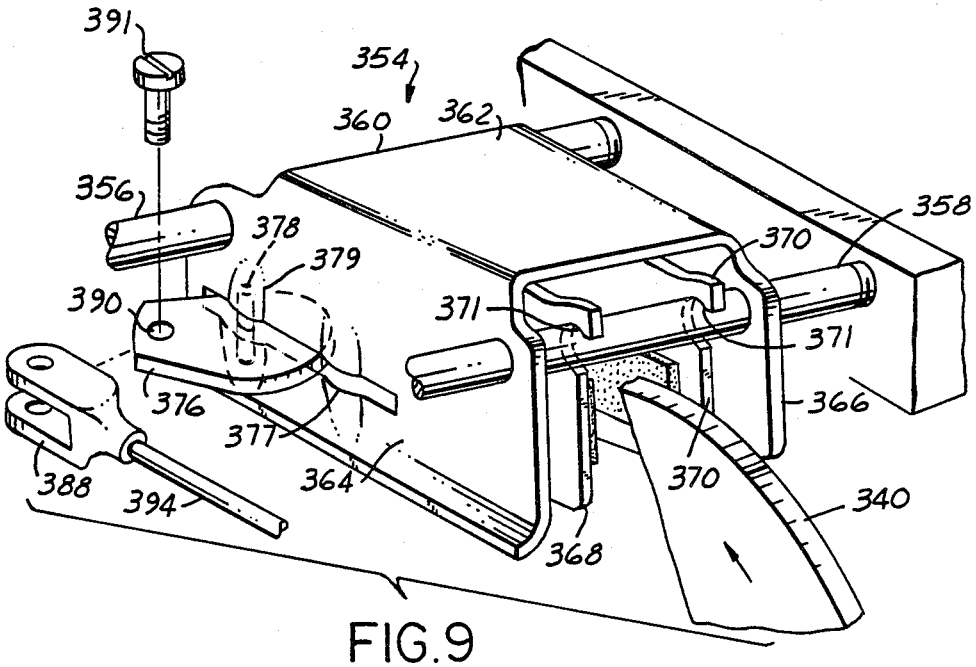
FIG. 9 is an enlarged fragmentary perspective view, having portions broken away, of another portion of the embodiment of FIG. 6.

FIGS. 9 and 13 show a clevis 388 that fits onto cam 376. The cam contains a hole 390 in spaced relation from the roll pin axis and clevis 388 is adapted to fit onto the cam in such a manner that the holes in the clevis align with hole 390. Attachment is made by a fastener 391, a screw for example, that is used to fasten the two together. Clevis 388 is at the end of a cable 394 and it is via this cable that the person operates unit 354 to set the desired load resistance. As can be seen in FIG. 6, cable 394 is generally parallel with bar 306, extending through a suitable aperture 396 in frame 302 and thence to a load resistance setting mechanism, 398 generally, that mounts on bar assembly 306 at a level below handle bar 308. Further details of mechanism 398 can be seen with reference to FIGS. 10 and 11.

Mechanism 398 comprises a square tube 400 that is affixed to bar assembly 396 by means of a mounting plate 402. A square slide bar 404 that is also of tubular shape is telescopically received in the end of tube 400 that is toward frame 302. A sheave assembly 406 mounts on the free end of slide bar 404. The sheave 408 of sheave assembly 406 comprises an axis 410 that is generally horizontal. Sheave 408 trains cable 394 for a ninety degree transition that enables the cable to pass through a small hole through slide bar 404 and enter a spring tube and indicator assembly 412 that mounts on the side of slide bar 404 opposite sheave assembly 406.

The spring tube and indicator assembly 412 comprises an outer circular cylinder tube 414, an inner circular cylinder tube 416 and a helical compression spring 418. The lower end of outer tube 414 is affixed to slide bar 404. A cylindrical retainer 410 for fitting into the lower end of spring 418 is also affixed to slide bar 404 concentric with tube 414. Inner tube 416 telescopically fits within outer tube 414 but has a noticeably shorter length than tube 414. The lower end of inner tube 416 is open while the upper end is closed by a circular end wall 422. Cable 394 enters the lower end of outer tube 414 passing concentrically through an opening through spring retainer 420 and concentrically through the convolutions of spring 418. The end of the cable is tethered to the center of end wall 422 in any suitable manner, such as by providing a small hole in end wall 422, passing the cable through the hole and then crimping a stopper or other device onto the end of the cable. Spring 418 serves to bias inner tube 416 upwardly with respect to outer tube 414 as viewed in FIG. 10. The FIG. 10 position represents a substantially relaxed condition of the spring.

If slide bar 404 is now displaced more fully into tube 400, the axis 410 of sheave 408 will be displaced farther from brake unit 354 by a like amount. Since the length of cable 394 between its points of connection to end wall 422 of tube 416 and cam 376 must remain constant, the increased displacement in the distance of axis 410 from brake unit 354 must be taken up by a shortening of the distance between end wall 422 and sheave 408. Consequently inner tube 416 is pulled downwardly within outer tube 414 with spring 418 being compressed in the process. Such a condition is portrayed in FIG. 11. The compression of spring 418 imparts an increased tension to cable 394 so that consequently an increased pulling force is applied on cam 376 to more forcefully urge the calipers and pads against rotor 340. The construction of mechanism 398 is such that a continuous range of settings for the spring tension, and hence for the amount of load resistance imposed by the caliper pads on the rotor, is achieved.

Figure 10:
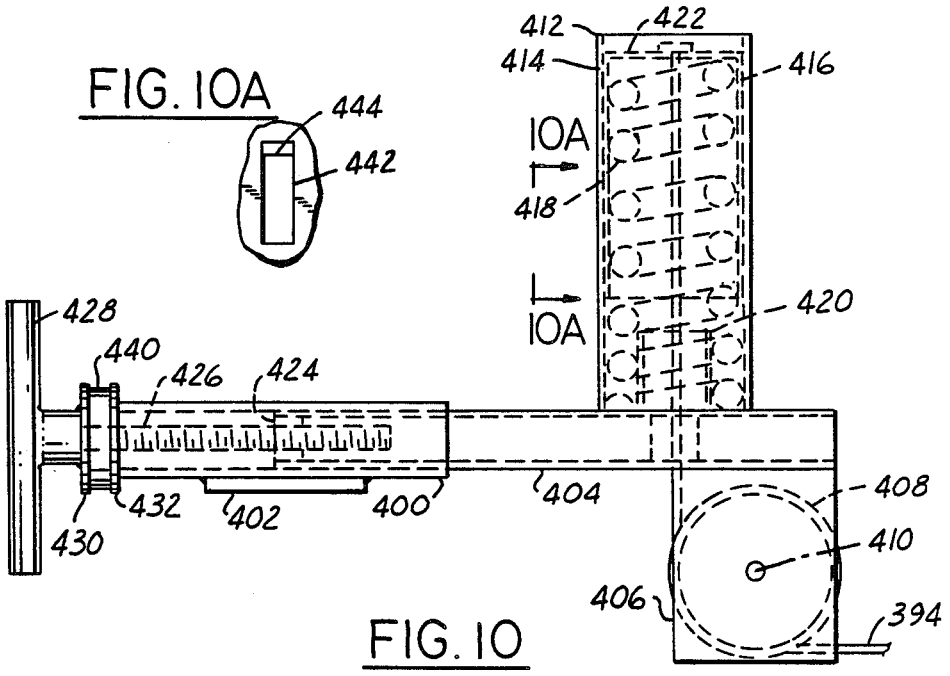
FIG. 10 is an enlarged view taken generally in the direction of arrows 10—10 in FIG. 6.
Figure 11:
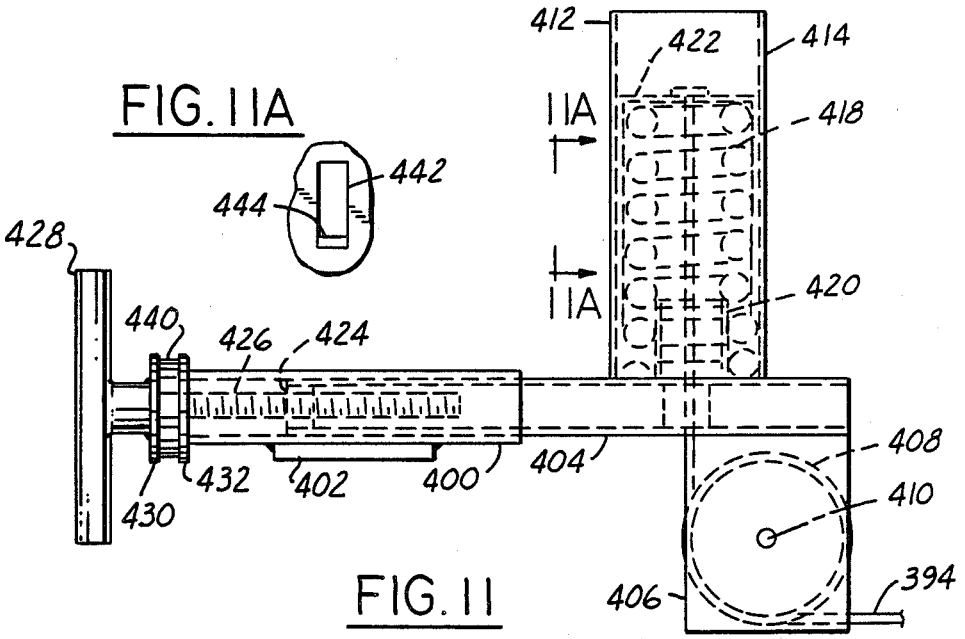
FIG. 11 is a view similar to FIG. 10 but showing a different position of adjustment.
Figure 12:
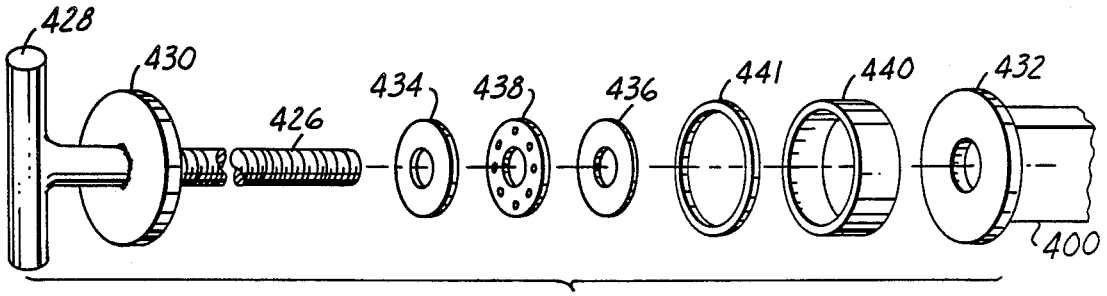
FIG. 12 is an exploded perspective view, on a slightly enlarged scale, of the left hand end of FIG. 10.

FIGS. 10, 11 and 12 portray the means by which the setting is adjusted. A nut 424 is provided on the end of slide bar 404 which is interior of tube 400. Nut 424 is engaged by a screw thread 426. The screw thread extends to a T-handle 428 which is exterior of tube 400 opposite the end of tube 400 into which slide bar 404 is received. The screw thread 426 and its T-handle 428 are rotatably mounted generally coaxial with tube 400. Details of the mounting can be seen in FIG. 12.

Circular washers, 430 and 432 respectively, are affixed to the shank of T-handle 428 and to the end of tube 400 respectively, in the manner shown. Between the two fixed washers are a pair of thrust washers 434, 436 sandwiching a bearing assembly 438. The screw thread 426 passes through washer 434, bearing assembly 438, washer 434 and washer 432 to enter tube 400 where it threads into nut 424 in the end of slide bar 404. A circular annular sleeve 440 of the same O.D. as washers 430, 432 fits between these two washers concealing the internal parts 434, 436, 438 a fibre washer 441 is disposed between sleeve 440 and washer 430.

Since the T-handle 428 cannot be displaced axially inwardly of tube 400, rotation of the T-handle serves to extend and retract slide bar 404 in a corresponding amount via the action of screw 426 and nut 424, thereby producing a corresponding tensioning of spring 418 and hence a corresponding resistance loading of rotor 340 via the caliper pads. The use of a rotary setting device, as illustrated, is desirable because it enables relatively precise settings to be obtained throughout the full range of settings. Sleeve 440 is of elastomeric construction and is axially compressed between washers 430 and 432. Washer 441 provide a surface against which washer 430 rotates when T-handle 428 is operated. Sleeve 440 functions like a constant force brake acting on T-handle 428 and is for the purpose of resisting turning of the T-handle and screw, particularly when the tension imparted to cable 394 by spring 418 is low. Absent a means such as sleeve 440 or an equivalent arrangement, shocks and vibrations that occur over certain surfaces 312 could result in screw 426 accidentally backing off thereby resulting in loss of desired tensioning in cable 394, and hence accidental change in the desired setting of unit 354.

Assembly 412 also incorporates an indicator for indicating the particular setting. This is accomplished by means of a rectangular window 442 in the side wall of outer tube 414 where this tube overlaps inner tube 416. The window faces the user. An indicator 444 is marked on the side wall of inner tube 416 in circumferential registry with window 442. The length of the window 442 is sufficient that the indicator 444 can be seen for all positions of compression of spring 418 by inner tube 416 within outer tube 414. By placing graduations on outer tube 414 along the side of the window 442 the indicator 444 may be read against such graduations.

While the device is typically set before the exercise machine is put to use, the advantageous organization and arrangement of adjustable load resistance enables the individual to conveniently change the load resistance while the machine is in use. Note that the T-handle 428 is conveniently located in relation to the handlebar so that it is possible for the user to continue to push the handlebar with one hand while adjusting the load resistance via the T-handle with the other hand.

It should be mentioned the brake unit 354 is a conventional commercially available unit. The screws 382, 384 are made adjustably positionable on end wall 366 to enable certain adjustments to be made. For example, the screws can be adjusted to accommodate variations in rotor thickness and also to some extent to compensate for wear of the friction pads.

Like certain preceding embodiments of the invention, exercise machine 300 advantageously employs the epicylic gear mechanism as a differential. However, unlike conventional differentials in which the power flow would be from the differential to the wheels, the exercise machine of the present invention utilizes the differential to receive power flow from the wheels. It is this power flow from the wheels that is absorbed in the brake calipers. In other words, the individual pushing or pulling the exercise machine will expend energy to rotate the wheels along the ground, road, sidewalk, or other underlying surface on which the tires 316, 318 are supported. Hence he or she creates the power input to the wheels which in turn is transmitted via the axles through the epicylic gear mechanism to rotate the unit 326 and disk 340. Since the setting of the caliper pads against opposite sides of the disk will determine the load resistance imposed on the differential, the user can achieve a setting for the machine that is compatible with the desired speed at which the user wishes to operate the machine and with the desired amount of force which the user desires to exert on the machine. The differential or epicyclic mechanism is also especially advantageous when the user is exercising along a path other than a flat, straight one. The differential mechanism takes into account variations in individual wheel velocity, depending upon departures from straight line travel, so that the effect as far as the user is concerned is rather minimal. For example the user can push the machine around a curve while maintaining consistent tread action with the underlying surface even though the two wheels are traveling at different velocities. Thus the differential contributes to smooth consistent operation of the exercise machine over different courses of use. To a certain extent it also acts somewhat like a flywheel to attenuate wheel pulsing that may occur during use, but without the usual flywheel effect; it tends to cushion wheel pulsing without the more substantial inertia that would be present in a flywheel and that would likely be deemed undesirable by users when accelerating or decelerating the machine.

Unit 326 provides what may be considered an automatic control that proportionally changes the speed of disk 340 in accordance with variation in the speeds of the individual wheels. For a given setting of the calipers, full resistance is attained when the machine is pushed or pulled in a straight line with both wheels rotating in the same sense at the same velocity. If there is a departure from straight line travel such that the wheels do not uniformly rotate at the same velocity, the speed of disk 340 automatically reduces to maintain proportionality to the average speed of the two wheels. This directionally-variable resistance feature of the machine approximates the directionally-variable input power curve of an average user as determined by actual and extensive testing. This capabilitity is embodied by the reverse driving of the differential and is a consequence of each of the two individual axle shafts accounting for at most up to one half of the rotational speed of disk 340.

Further advantage of the directionally variable input resistance feature is seen if the two shafts are rotated simultaneously in opposite directions at the same speed. In this case unit 354 and disk 340 do not revolve. This attribute allows the user to set the resistance even to a very high level, to exercise with the machine along a relative narrow lane and when arriving at the end of the lane turn the machine about without difficulty because the machine in effect automatically goes into neutral when the machine is pivoted in a manner such that the two wheels rotate in opposite senses at the same speed. This feature is especially useful when the machine is used in confined quarters or when several machines are pushed side by side and have to be turned around next to each other.

Bar assembly 306 contains a main tube **306*a* which attaches to frame 302 and to which mechanism 398 is affixed; it also contains an extension 306*b* that telecopically fits into the end of tube 306*a* and that contains handlebar 308. There is a joint that connects tube 306*a* and extension 306*b* when the extension is extended from the tube a desired amount for the particular individual user. The connection comprises a bolt 306*c* that passes through aligned holes in tube 306*a* and extension 306*b*. Extension 306*b* has a series of holes 306*e* at different locations along its length, such as every inch for example, to provide different positions of adjustment for the extension, and hence different overall lengths for bar assembly 306. After the bolt 306*c* has been passed through the aligned holes, a nut, such as a wing nut (not shown), is threaded onto the shank end and tightened. So that a tool, such as a wrench, is not required to hold the bolt head during tightening of the nut, a small plate 306*d* containing a milled slot and a hole is affixed to one side of tube 306*a*** over the bolt hole. The milled slot in the small plate engages opposite flats of the bolt head when the bolt is fully inserted through the aligned holes, and thereby prevents the bolt from turning while the wing nut is being tightened.

While the preferred embodiment of the invention has been disclosed, it will be appreciated that principles are applicable to other embodiments.

What is claimed is:

1. Locomotion exercise enhancement equipment comprising frame means which is supported for rolling motion along ground by wheel means, said frame means having means adapted for engagement by the user to perform exercise by imparting rolling motion to the equipment, a rotary load, means for supporting said rotary load for rotation on said frame means, coupling means operatively coupling said rotary load in a driven relationship with said wheel means such that when the user imparts rolling motion to the equipment the rotary load is driven by said wheel means, said wheel means being a pair of independent wheels disposed on opposite sides of said frame means and lying on a common axis, said coupling means comprising a differential mechanism that is housed within a housing and is driven by said pair of wheels to drive said housing and in turn drive said rotary load, and means for varying the effective loading imposed by said rotary load on said wheel means comprising a disk that is driven by the differential housing in response to driving of the differential housing by said pair of wheels, and a brake mechanism that is selectively operable to impose a selectable friction load on said disk.

2. Locomotion exercise enhancement equipment as set forth in claim 1 in which said brake mechanism is a caliper brake mechanism comprising a pair of calipers having brake pads disposed on opposite sides of the disk and which are operable to impose a selectable friction load on the disk which is substantially equalized on each side of the disk.

3. Locomotion exercise enhancement equipment as set forth in claim 2 in which said caliper brake mechanism is operated by means of a lever that has a camming surface acting directly on one of said calipers and a cable for operating said lever which extends from said lever to an adjustment mechanism that is operated by the user of the equipment to set a desired friction load on said disk.

4. Locomotion exercise enhancement equipment as set forth in claim 3 including a bar attached to said frame means having hand grip means adapted for engagement by the user and wherein said adjustment mechanism is disposed proximate said having grip means for adjustment, via said cable, of the caliper brake mechanism by the user.

5. Locomotion exercise enhancement equipment as set forth in claim 4 in which said adjustment mechanism comprises a pair of telescopically engaged members, one of said members being fixedly mounted on said bar in fixed relation to said caliper brake mechanism and the other of said members being telescopically adjustable on said one member to act upon the caliper brake mechanism via said cable.

6. Locomotion exercise enhancement equipment as set forth in claim 5 in which said members are arranged for telescopic adjustment in a direction parallel to that of said bar, said cable extends from said caliper brake mechanism substantially parallel to said bar to a sheave assembly that is mounted on said other member, said sheave assembly training said cable for transition to a spring-loading mechanism that is mounted on said other member with its axis generally transverse to the direction of telescopic adjustment of said members.

7. Locomotion exercise enhancement equipment as set forth in claim 6 in which said spring-loading mechanism comprises inner and outer elements that are telescopically engaged, one of said elements being fixedly mounted on said other member and the other of said elements being telescopically movable with respect to said one element, said cable having a point of tethering to said other element, and said other element having coaction with a spring of said spring-loading mechanism such that as the adjustment mechanism is adjusted by the user to change the distance of said sheave assembly from said caliper brake assembly, said cable acts to correspondingly change the force that is exerted in the cable via said spring.

8. Locomotion exercise enhancement equipment as set forth in claim 7 in which said element comprises an outer tube and said other element comprises an inner tube that telescopes within said outer tube, said spring being a helical compression spring that is disposed within said tubes, said inner tube having an end wall that bears against an end of said helical compression spring, said cable being tethered to said end wall to cause said end wall to act on said spring as the adjustment mechanism is being adjusted.

9. Locomotion exercise enhancement equipment as set forth in claim 8 including a window in the side wall of said outer tube that overlaps the side wall of said inner tube, said side wall of said inner tube having an indicator which is visible through said window and which is positioned along said window in a correspondence with the extent of adjustment of said adjustment mechanism to thereby provide an indicator corresponding to the spring tension imparted to the cable by said spring.

10. Locomotion exercise enhancement equipment as set forth in claim 5 in which said one member comprises a tube of non-circular cross section and including a rotary actuator for adjusting the telescopic position of the other of said members relative to said one member comprising a handle that is disposed at the one end of said tube opposite the end at which the other member is in telescopic engagement therewith, a bearing mechanism disposed between the actuator and the one end of said tube to support the actuator for rotary motion that is generally coaxially with said tube, and a screw and nut mechanism that operatively couples the actuator with said other of said members.

11. Locomotion exercise enhancement equipment as set forth in claim 1 in which said means for varying the effective loading imposed by said rotary load on said wheel means further comprises a spring-loading mechanism that is operatively coupled to said brake mechanism by means of a cable and means for selectively positioning said spring-loading mechanism in relation to said brake mechanism to selectively set the spring tension imposed in the cable and in turn the selectable friction load that is imposed on said disk b said brake mechanism.

12. Locomotion exercise enhancement as set forth in claim 11 in which spring-loading mechanism comprises an outer tube that is bodily selectively positionable on the equipment in relation to said brake mechanism and an inner tube that telescopes with in said outer tube, a spring disposed within said tubes, said cable being tethered to said inner tube such that as said outer tube is bodily selectively positioned in relation to brake mechanism, said spring is increasingly compressed to impart increasing tension to the cable.

13. Locomotion exercise enhancement equipment as set forth in claim 1 in which said disk is affixed to said differential housing and is concentric with said common axis, said disk and differential mechanism being disposed closer to one of said wheels than the other of said wheels.

14. Locomotion exercise enhancement equipment as set forth in claim 13 including a bar attached to said frame means and having handgrip means adapted for engagement by the user, said bar being arranged generally transverse to said common axis and being generally centered with respect to said wheels, said means for varying the effective loading imposed by said rotary load on said wheel means further comprising an adjustment mechanism that is operated by the user of the equipment to set a desired friction load on said disk, said adjustment mechanism being disposed proximate said handgrip means to the same side of said bar as the side that is toward the one wheel which is nearer the disk and differential mechanism.

15. Locomotion exercise enhancement equipment as set forth in claim 14 in which said adjustment mechanism comprises a pair of telescopically engaged members, one of said members being fixedly mounted on said bar in fixed relation to said brake mechanism and the other of said members being telescopically adjustable on said one member to act upon the brake mechanism via said cable.

16. Locomotion exercise enhancement equipment as set forth in claim 15 in which said members are arranged for telescopic adjustment in a direction parallel to that of said bar, said cable extends from said caliper brake mechanism substantially parallel to said bar to a sheave assembly that is mounted on said other member, said sheave assembly training said cable for transition to a spring-loading mechanism that is mounted on said other member with its axis generally transverse to the direction of telescopic adjustment of said members.

17. Locomotion exercise enhancement equipment as set forth in claim 16 in which said spring-loading mechanism inner and outer elements that are telescopically engaged, one of said elements being fixedly mounted on said other member and the other of said elements being telescopically movable with respect to said one element, said cable having a point of tethering to said other element, and said other element having coaction with a spring of said spring-loading mechanism such that as the adjustment mechanism is adjusted by the user to change the distance of said sheave assembly from said brake assembly, said cable acts to correspondingly change the force that is exerted in the cable via said spring, in which said one element comprises an outer tube and said other element comprises an inner tube that telescopes within said outer tube, said spring being a helical compression spring that is disposed within said tubes, said inner tube having an end wall that bears against an end of said helical compression spring, said cable being tethered to said end wall to cause said end wall to act on said spring as the adjustment mechanism is being adjusted, including a window in the side wall of said outer tube that overlaps the side wall of said inner tube, said side wall of said inner tube having an indicator which is visible through said window and which is positioned along said window in a correspondence with the extent of adjustment of said adjustment mechanism to thereby provide an indicator corresponding to the spring tension imparted to the cable by said spring.

18. Locomotion exercise enhancement equipment comprising frame means which is supported for rolling motion along ground by wheel means, said frame means having means adapted for engagement by the user to perform exercise by imparting rolling motion to the equipment, a rotary load, means for supporting said rotary load for rotation on said frame means, coupling means operatively coupling said rotary load in a driven relationship with said wheel means such that when the user imparts rolling motion to the equipment, the rotary load is driven by said wheel means, said wheel means being a pair of independent wheels disposed on opposite sides of said frame means and lying on a common axis, selectable setting means to select a selectable resistance force acting on the rotary load such that the effective rotary load for straight line motion of the equipment may be set to a desired load at a given speed, said coupling means further including means to automatically attenuate the effective resistance load in response to departures from straight line motion at said given speed without changing the setting of said selectable setting means.

19. Locomotion exercise enhancement equipment is set forth in claim 18 in which said coupling means comprises means to cause the rotation of said rotary load to cease in response to a circular turning motion imparted to the exercise equipment that results in the wheels both moving at the same rotational velocity but in opposite rotational senses.

20. Locomotion exercise enhancement equipment comprising frame means which is supported for rolling motion along ground by wheel means, said frame means having means adapted for engagement by the user to perform exercise by imparting rolling motion to the equipment, a rotary load, means for supporting said rotary load for rotation on said frame means, coupling means operatively coupling said rotary load in a driven relationship with said wheel means such that when the user imparts rolling motion to the equipment, the rotary load is driven by said wheel means, said wheel means being a pair of independent wheels disposed on opposite sides of said frame means and lying on a common axis, selectable setting means to select a selectable resistance force acting on the rotary load such that the effective rotary load for straight line motion of the equipment may be set to a desired load at a given speed, said coupling means further including means to cause the rotation of said rotary load to cease in response to a circular turning motion imparted to the exercise equipment that results in the wheels both moving at the same rotational velocity but in opposite rotational senses.

* * * * *